US005584718A

United States Patent [19]

Sukegawa

[11] Patent Number: 5,584,718

[45] Date of Patent: Dec. 17, 1996

[54] BRANCH-CONNECTION CONNECTOR

[75] Inventor: Akihito Sukegawa, Ibaraki, Japan

[73] Assignee: Mitsumi Electric Co., Ltd., Tokyo, Japan

[21] Appl. No.: 363,833

[22] Filed: Dec. 27, 1994

[30] Foreign Application Priority Data

Dec. 29, 1993 [JP] Japan ..... 5-076030 U

[51] Int. Cl.[6] ..... H01R 13/627

[52] U.S. Cl. ..... 439/352; 439/607

[58] Field of Search ..... 439/607–610, 439/638–655, 746, 748, 352, 353

[56] References Cited

U.S. PATENT DOCUMENTS

| | | | |
|---|---|---|---|
| 3,408,614 | 10/1968 | Kuwahata | 439/353 |
| 3,699,498 | 10/1972 | Hardesty et al. | 439/248 |
| 3,745,515 | 7/1973 | Michaels | 439/651 |
| 4,386,819 | 6/1983 | Asick | 439/610 |
| 4,508,414 | 4/1985 | Kusui et al. | 439/610 |
| 5,064,389 | 11/1991 | Klein et al. | 439/651 |
| 5,417,593 | 5/1995 | Suzuki et al. | 439/651 |

FOREIGN PATENT DOCUMENTS 642370 1/1989 Japan .

*Primary Examiner*—Hien Vu

*Attorney, Agent, or Firm*—Whitham, Curtis, Whitham & McGinn

[57] ABSTRACT

A branch-connection connector having a plug portion and a socket portion, which can be fitted into one another, are formed respectively at a front side and a rear side of a cover which forms an outer peripheral surface portion of the connector. A lock engagement piece is connected to the plug portion, and a lock release button is provided on a peripheral surface portion of the cover. The lock engagement piece is resiliently bendable, and has a proximal end connected to the cover, and a retaining projection, which can be fitted in an engagement recess formed in the socket portion of another said connector. The retaining projection is movable into and out of the plug portion and is formed on a free end of the lock engagement piece. A lock release button is fixedly secured at its proximal end to the cover. A free end of the lock release button can press down a portion of the lock engagement piece between the proximal end and free end of the lock engagement piece, thereby moving the retaining projection into the plug portion.

12 Claims, 6 Drawing Sheets

BRANCH-CONNECTION CONNECTOR

BACKGROUND OF THE INVENTION

1. Field of the Invention

This invention relates to a branch-connection connector in which a plug portion and a socket portion, which can be fitted relative to such a socket portion and such a plug portion, are formed respectively at a front side and a rear side of a cover which forms an outer peripheral surface portion of the connector. More particularly such a connector is suitable for connecting a plurality of computers or printers in a serial manner (daisy chain) to form a network.

2. Related Art

A conventional branch-connection connector of the type described will be briefly described with reference to FIG. 13. In the connector 50 shown in this Figure, a plug portion 12 and a socket portion 14, which can be fitted respectively relative to such a socket portion and such a plug portion, are formed respectively at a front side and a rear side of a cover 16 forming an outer peripheral surface of the connector. A cord end insertion hole portion 22 for receiving a cord 19 comprising a bundle of wires (cables) is formed in one side of the cover 16.

In this connector 50, although not shown, a plurality of plug-type contact metal members are provided in the plug portion 12, and a plurality of socket-type contact metal members are provided in the socket portion 14. The plug-type contact metal members and the socket-type contact metal members are electrically connected together by suitable means in the connector, and the wires of the cord 19 are electrically connected to the socket-type contact metal members.

A plurality of externally-threaded portions 52 are formed on the front end face (where the plug portion 12 is provided) of the cover 16, and a plurality of internally-threaded portions 54 are formed on the rear end face (where the socket portion 14 is provided) of the cover. When the connectors 50 are to be connected and fixed together, the plug portion 12 is fitted in the mating socket portion 14 as shown in FIG. 14, so that the contact metal members at these portions are electrically contacted and connected together. The externally-threaded portions 52 of one connector 50 are engaged with the internally-threaded portions 54 of the other connector 50, and are tightened.

However, when the conventional branch-connection connectors 50 are to be connected and fixed together, and are to be disengaged and disconnected from each other, the plurality of externally-threaded portions and the plurality of internally-threaded portions must be engaged with each other, as described above, and therefore much time and labor have been required for the connection-fixing operation and the disengagement-disconnection operation.

SUMMARY OF THE INVENTION

With the above problem in view, it is an object of this invention to provide a branch-connection connector which enables the connection-fixing operation and the disengagement-disconnection operation to be done with one touch easily and rapidly.

The above object has been achieved by a branch-connection connector comprising: a plug portion and a socket portion, which can be fitted respectively relative to such a socket portion and such a plug portion, formed respectively at a front side and a rear side of a cover forming an outer peripheral surface portion of the connector. A lock engagement piece is provided in the cover and the plug portion in a manner to extend over the areas of these portions, and a lock release button is provided on the peripheral surface portion of the cover. The lock engagement piece is resiliently bendable, and has a proximal end fixed within the cover, and a retaining projection, which can be fitted in an engagement recess formed in the socket portion of another connector, and is movable into and out of the plug portion, being formed on a free end of the lock engagement piece. The lock release button is fixedly secured at its proximal end to the peripheral surface portion of the cover, and a free end of the lock release button can press down a portion of the lock engagement piece between the proximal end and the free end, thereby moving the retaining projection into the plug portion.

When the branch-connection connectors of the above construction according to the present invention are to be connected and fixed together, the plug portion of one connector is inserted into the socket portion of the other connector. As a result, the retaining projection of the lock engagement piece of the one connector projecting from the outer peripheral surface of the plug portion is pressed down by the inner peripheral surface of the socket portion of the other connector. Thus, the lock engagement piece is bent to move the retaining projection into the plug portion, and when the plug portion is completely fitted into the socket portion, the retaining projection is disposed beneath (above) the engagement recess in the socket portion, so that the lock engagement piece is returned to its initial position by its own resilient force, and the retaining projection is fitted into the engagement recess, so that the two branch-connection connectors are serially connected together in a fixed manner.

On the other hand, when the two branch-connection connectors are to be disconnected from each other by breaking their fixedly-connected condition, the lock release button of a first connector fitted in the socket portion of another connector is depressed. As a result, that portion of the lock engagement piece of the first connector between the proximal end and the retaining projection is pressed down, so that the retaining projection is moved into the plug portion, and in this condition the plug portion of the first connector is withdrawn from the socket portion of the other connector, thereby breaking the fixedly-connected condition, thus disconnecting the two connectors from each other.

DETAILED DESCRIPTION OF THE PREFERRED EMBODIMENTS

A preferred embodiment of the present invention will now be described with reference to the drawings.

Figure 1:
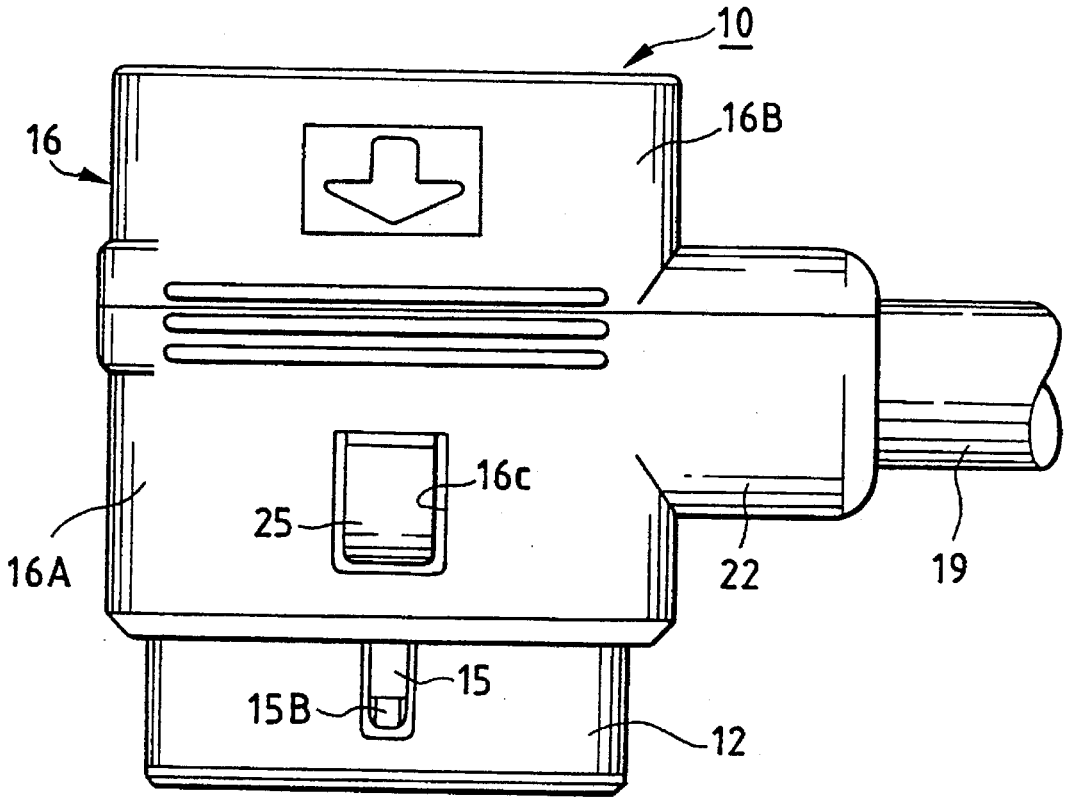
FIG. 1 is a plan view showing an overall construction of one preferred embodiment of a branch-connection connector of the present invention.
Figure 2:
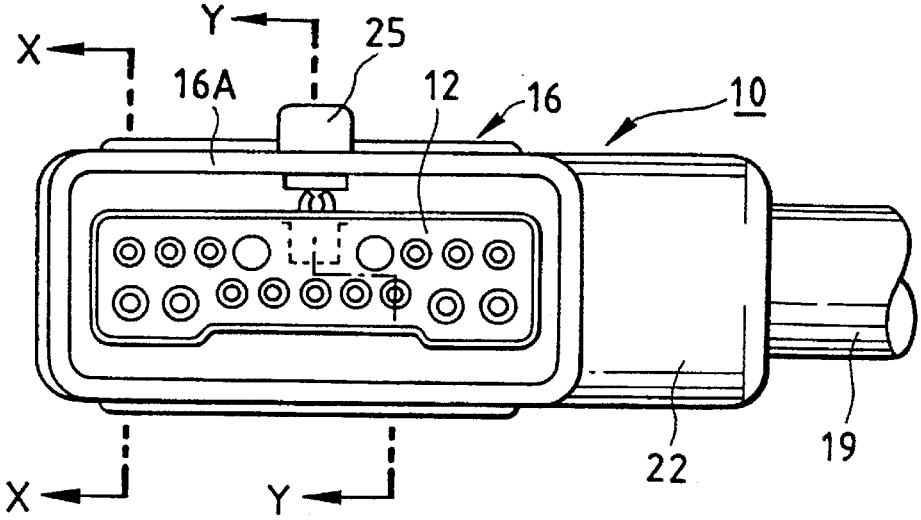
FIG. 2 is a front-elevational view of the connector of FIG. 1 as seen from a socket portion side.
Figure 3:
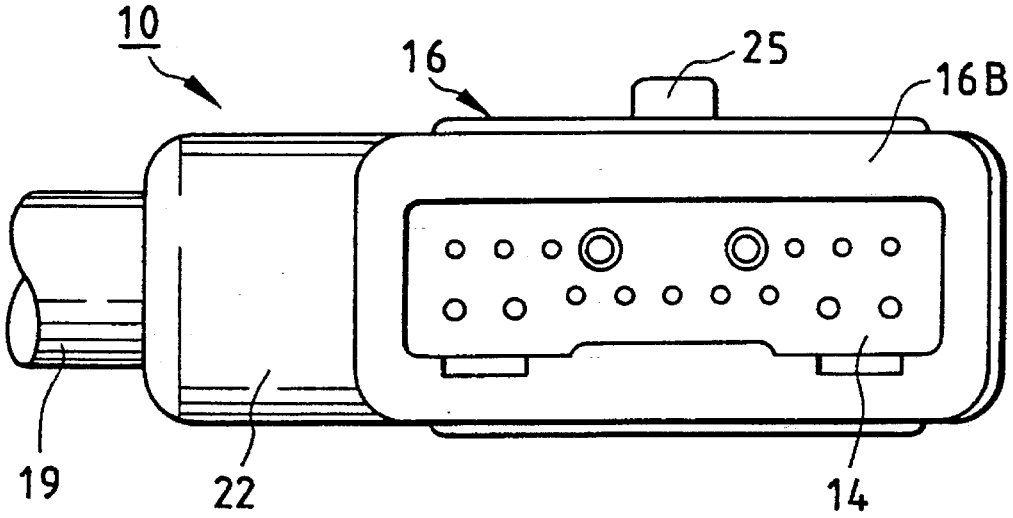
FIG. 3 is a rear view of the connector of FIG. 1 as seen from a plug portion side.
Figure 4:
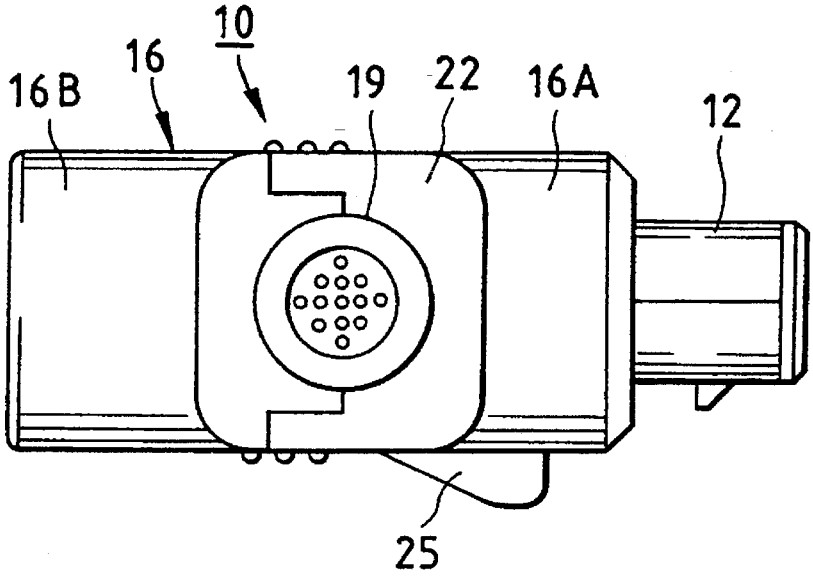
FIG. 4 is a side-elevational view of the connector of FIG. 1 as seen from a cord side.
Figure 5:
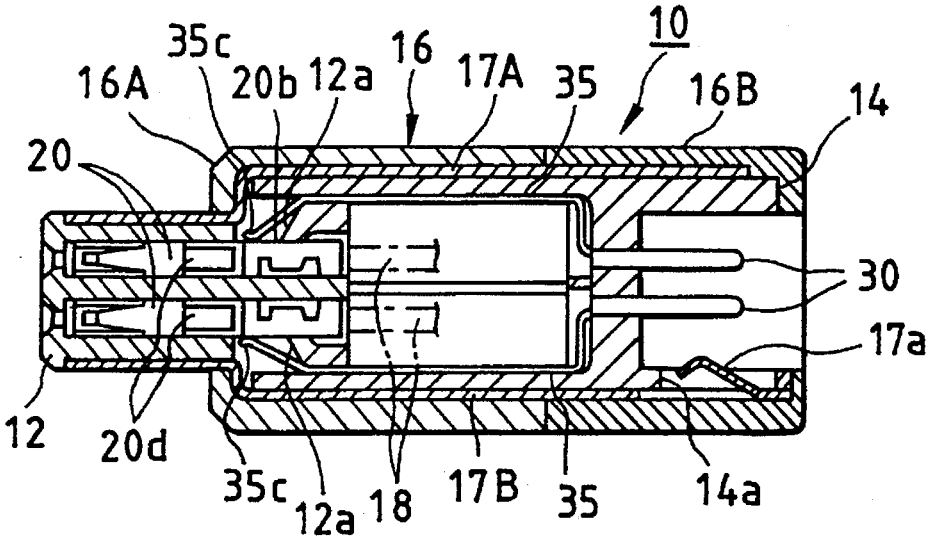
FIG. 5 is a cross-sectional view taken along the line X—X of FIG. 2.
Figure 6:
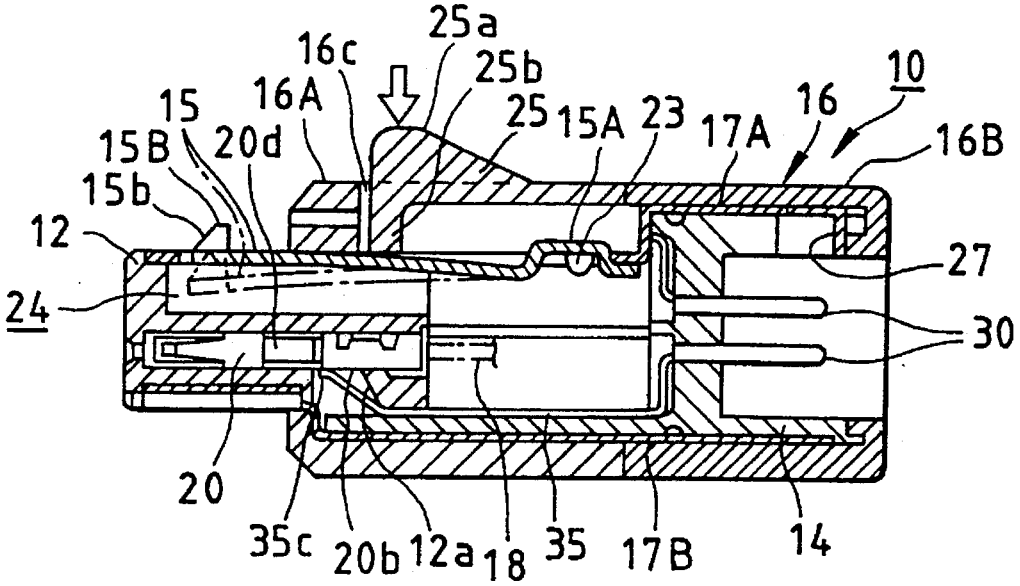
FIG. 6 is a cross-sectional view taken along the line Y—Y of FIG. 2.
Figure 7:
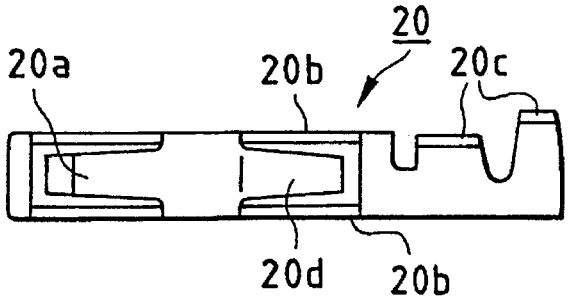
FIG. 7 is a side-elevational view of a socket-type contact metal member in the embodiment.
Figure 8:
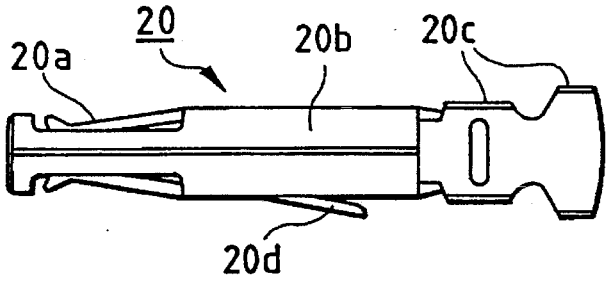
FIG. 8 is a plan view of the socket-type contact metal member.
Figure 9:
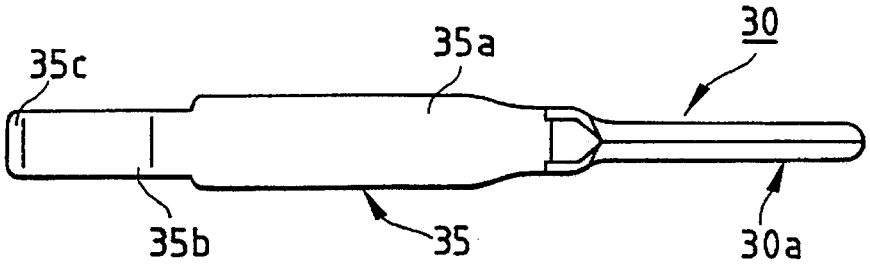
FIG. 9 is a plan view of a plug-type contact metal member in the embodiment.
Figure 10:
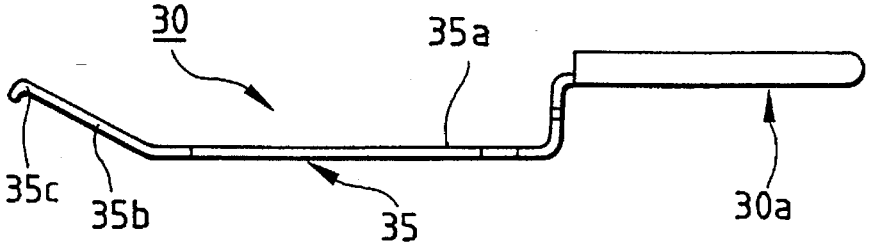
FIG. 10 is a side-elevational view of the plug-type contact metal member.

FIGS. 1 to 10 are provided for describing one preferred embodiment of a branch-connection connector of the present invention, and FIG. 1 is a plan view showing an overall construction, FIG. 2 is a front-elevational view as seen from a socket portion side, FIG. 3 is a rear view as seen from a plug portion side, FIG. 4 is a side-elevational view as seen from a cord side, FIG. 5 is a cross-sectional view taken along the line X—X of FIG. 2, FIG. 6 is a cross-sectional view taken along the line Y—Y of FIG. 2, FIGS. 7 and 8 are a side-elevational view and a plan view of a socket-type contact metal member, respectively, and FIGS. 9 and 10 are a plan view and a side-elevational view of a plug-type contact metal member.

Figure 13:
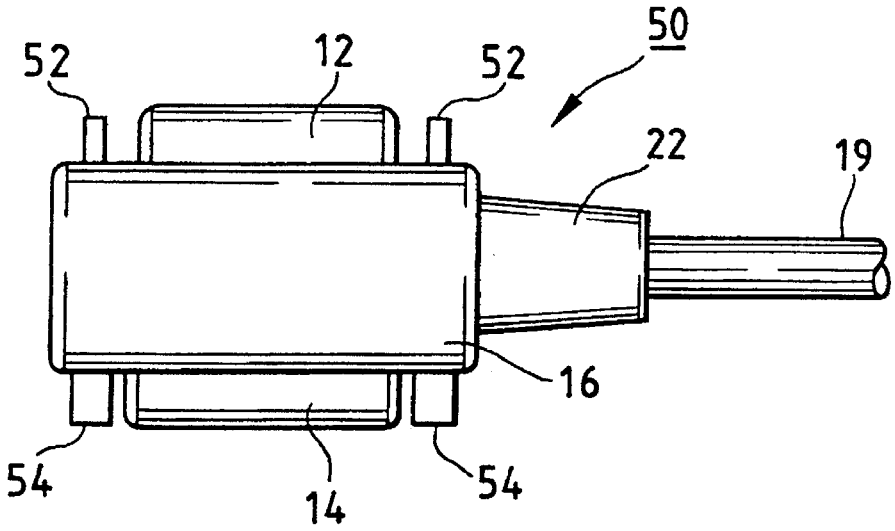
FIG. 13 PRIOR ART
FIG. 13 is a plan view of a conventional branch-connection connector.
Figure 14:
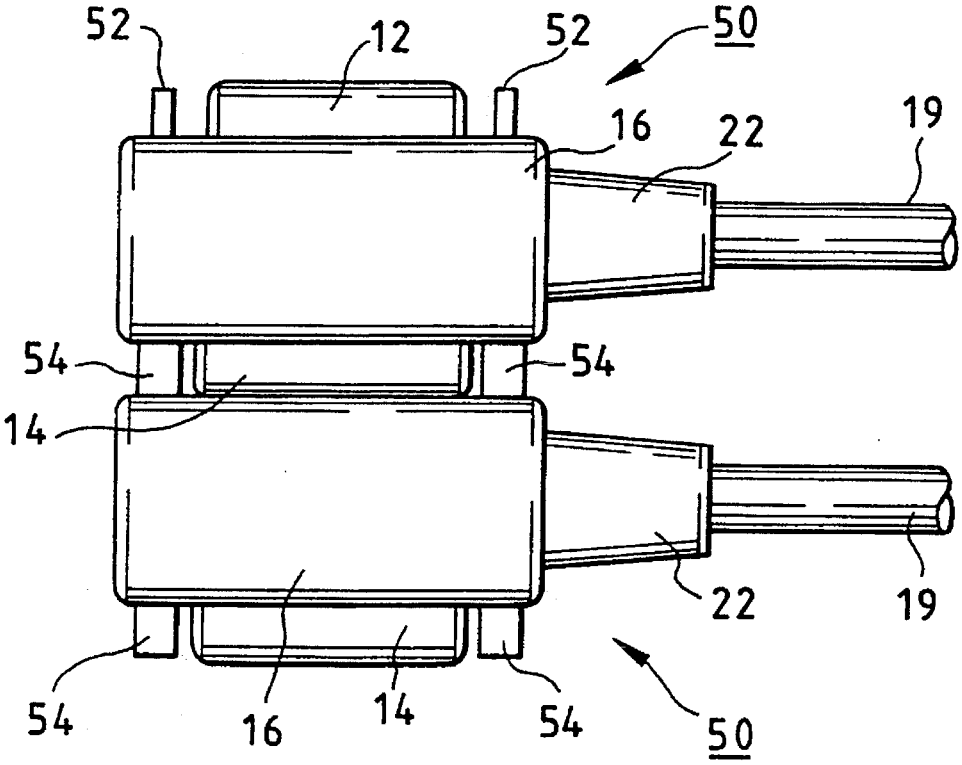
FIG. 14 PRIOR ART
FIG. 14 is a view showing the manner of connecting and fixing the conventional branch-connection connectors together.

In these Figures, those portions corresponding to those of the conventional branch-connection connector 50 of FIGS. 13 and 14 are designated by identical reference numerals, respectively.

In the branch-connection connector of this embodiment as in the conventional connector of FIGS. 13 and 14, a plug portion 12 and a socket portion 14, which are molded of a resin and can be fitted respectively relative to such a socket portion and such a plug portion, are formed respectively at a front side and a rear side of a cover 16 forming an outer peripheral surface portion of the connector. Socket-type contact metal members 20 and plug-type contact metal members 30, which can be fitted and contacted relative to such socket-type contact metal members and such plug-type contact metal members, are mounted on the plug portion 12 and the socket portion 14, respectively.

As shown in FIGS. 5 and 6 which are cross-sectional views, a contact metal insertion portion of the plug portion 12 and a contact metal insertion portion of the socket portion 14 are interconnected by a shield case and the cover 16, fitted on this shield case, and are spaced a predetermined distance from each other. The shield case of a two-split type comprises an upper shield case 17A and a lower shield case 17B, and the cover 16 of a two-split construction comprises a front cover 16A and a rear cover 16B welded thereto.

A cord end insertion hole portion 22 for receiving a cord 19 comprises a bundle of wires (cables) 18 are formed on and projects from one side of the front and rear covers 16A and 16B (cover 16). Within the connector 10, each of the wires 18 of the cord 19 is connected to a rear end of a respective one of the socket-type contact metal members 20.

As shown in FIGS. 7 and 8, the socket-type contact metal member 20 is formed by bending a metal plate, and has a tubular front end portion of a square cross-section (which has contact portions 20*a*) for receiving the mating plug-type contact metal member of the mating male connector, and also has a rear end portion defining a clamping portion 20*c* to which the wire 18 of the cord 19 is connected. The intermediate portion thereof is tubular, and has a square cross-section, and a withdrawal prevention lance 20*d* extends obliquely rearwardly from one side surface of this intermediate portion, and another one side surface of this intermediate portion serves as a contact portion 20*b* against which a connection conductor portion 35 (later described) of the plug-type contact metal member 30 is adapted to be pressed.

As shown in FIGS. 9 and 10, the plug-type contact metal member 30 is formed by bending a metal plate, and a front end portion thereof defines a cylindrical contact portion 30*a* for insertion into the mating socket-type contact metal member of the mating female connector, the contact portion 30*a* having a rounded end. The connection conductor portion 35 is formed integrally with the rear end of the contact portion 30*a*. The connection conductor portion 35 includes a L-shaped bridge portion 35*a*, which first extends substantially perpendicularly from the rear end of the contact portion 30*a*, and then extends horizontally, and a slanting portion 35*b* extending obliquely rearwardly from the bridge portion 35*a*.

The bridge portion 35*a* is disposed to provide a bridge between the plug portion 12 and the socket portion 14, and the slanting portion 35*b* is resiliently flexible relative to the bridge portion 35*a*. The slanting portion 35*b* is received in a recess 12*a* (FIGS. 5 and 6) formed in the plug portion 12, and a curved portion 35*c* formed at the distal end of the slanting portion 35*b* is pressed against the contact portion 20*b* of the socket-type contact metal member 20.

Within the plug portion 12, the socket-type contact metal members 20 are arranged in two (upper and lower) stages (Here, in the upper stage, 3 members are disposed at each of the opposite side portions (hence 6 members in all) while in the lower stage, 5 members are disposed at the central portion). The lances 20*d* of these members 20 are disposed at the lateral side, and the contact portions 20*b* of the members 20 in the upper stage are disposed at the upper side while the contact portions 20*b* of the members 20 in the lower stage are disposed at the lower side. Similarly, the plug-type contact metal members 30 are arranged in the socket portion 14 in such a manner that the members 30 in an upper stage are inverted in posture relative to the members 30 in a lower stage.

The connection conductor portion 35, integrally formed on the plug-type contact metal member 30, is pressed against the contact portion 20*b* of the socket-type contact metal member 20, so that the plug-type contact metal member and the socket-type contact metal member are electrically contacted and connected together.

An earth contact portion 17*a*, formed on the lower shield case 17B, extends into the socket portion 14 through an opening 14*a* (FIG. 5) formed in the socket portion.

In the branch-connection connector of this embodiment, in addition to the above construction, a lock engagement piece 15 is provided in the cover 16 and the plug portion 12 in a manner to extend over the areas of these portions, and a lock release button 25 is provided on the upper surface of the cover 16.

The lock engagement piece 15 is in the form of a resiliently bendable, narrow plate, and its proximal end portion 15A, bent into a convex shape, is supported by a support portion 23 formed transversely on the cover 16, and its distal end is retained by an inner end edge of the upper shield case 17A within the cover. Within the cover 16, the free end portion of this lock engagement piece is bendable upward and downward about the proximal end 15A in a recess 24 formed in an upper portion of the plug portion 12. A retaining projection 15B, having a slanting guide surface 15*b* at its front side, is formed on the free end of the lock engagement piece. This retaining projection is engageable in an engagement recess 27 formed in the socket portion 14, and is movable into and out of the recess 24 in the plug portion 12. When an external force is not applied to the lock engagement piece 15, the retaining projection 15B is projected upwardly from the plug portion 12.

The lock release button 25 has a convex operating portion 25*a* projecting from the upper surface of the cover 16, and a pressing portion 25*b* extending downwardly from the convex operating portion 25*a*. The proximal end of this button is fixedly secured to the upper surface portion of the cover 16 by suitable means (such as welding), and within an opening 16*c* in the cover 16, this button is bendably movable upward and downward about the proximal end thereof. When the convex operating portion 25*a* provided at the free end portion of this button is pressed down, the pressing portion 25*b* urges a portion of the lock engagement piece 15 between the proximal end 15A and the retaining projection 15B downward, thereby moving the retaining projection 15B into the recess 24 in the plug portion 12 as indicated in a dot-and-dash line in FIG. 6.

Figure 11:
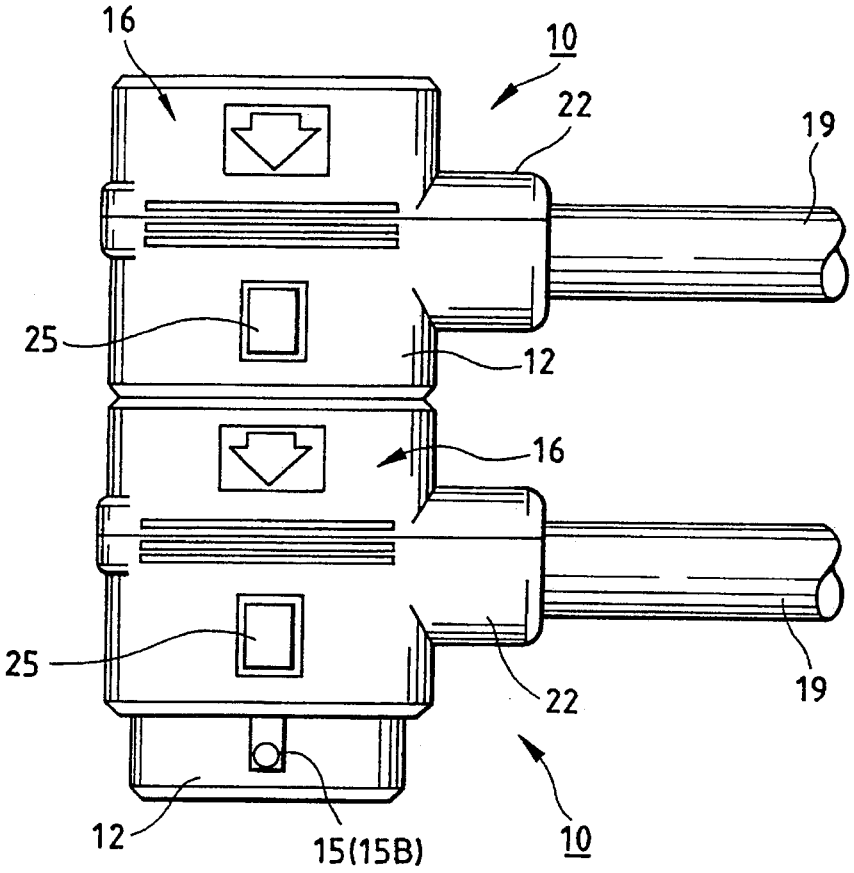
FIG. 11 is a view showing the manner of connecting and fixing the branch-connection connectors of the embodiment together.
Figure 12:
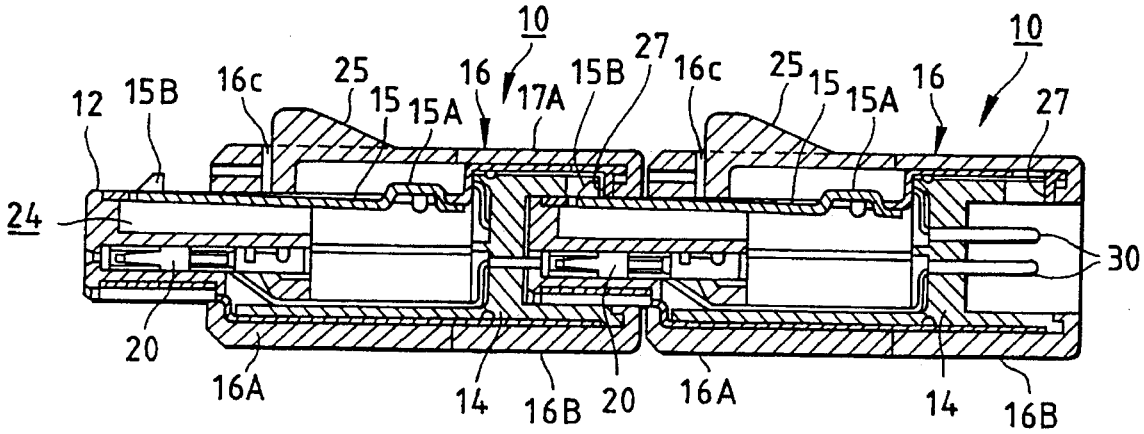
FIG. 12 is a cross-sectional view showing a condition in which the branch-connection connectors of the embodiment are connected and fixed together.

As will be appreciated from FIGS. 11 and 12 showing a connected and fixed condition, when the branch-connection connectors 10 of this embodiment are to be connected and fixed together, the plug portion 12 of one connector 10 is inserted into the socket portion 14 of the other connector 10. As a result, the retaining projection 15B (the slanting guide surface 15*b*) of the lock engagement piece 15 of the one connector 10 projecting from the outer peripheral surface of the plug portion 12 is pressed down by the inner peripheral surface of the socket portion 14 of the other connector 10. Thus, the lock engagement piece 15 is bent to once move the retaining projection 15B into the plug portion 12, and when the plug portion 12 is completely fitted into the socket portion 14, the retaining projection 15B is disposed beneath the engagement recess 27 in the socket portion 14, so that the lock engagement piece 15 is returned to its initial position because of its own resilient force, and the retaining projection 15B is fitted into the engagement recess 27, so that the two branch-connection connectors 10 and 10 are serially connected together in a fixed manner. In this condition, the plug-type contact metal members 30 of the socket portion 14 are inserted into the socket-type contact metal members 20 of the plug portion 12 to be electrically connected thereto, respectively.

When the two branch-connection connectors 10 are to be disconnected from each other by breaking their fixedly-connected condition, the lock release button 25 of the one connector 10 fitted in the socket portion 14 of the other connector 10 is depressed. As a result, that portion of the lock engagement piece 15 of the one connector between the proximal end 15A and the retaining projection 15B is pressed down, so that the retaining projection 15B is moved into the plug portion 12, and in this condition the plug portion 12 of the one connector 10 is withdrawn from the socket portion 14 of the other connector, thereby breaking the fixedly-connected condition, thus disconnecting the two connectors from each other.

Thus, in the branch-connection connector of this embodiment, the connection-fixing operation and the disengagement-disconnection operation for these connectors can be done with one touch easily and rapidly.

In the above embodiment, although the single lock release button and the single lock engagement piece are provided, a plurality of such members may be provided at the upper and lower portions.

As is clear from the above description, there is obtained an advantage that the connection-fixing operation and the disengagement-disconnection operation for these connectors can be done with one touch easily and rapidly.

What is claimed is:

1. An electrical branch-connection connector, comprising:

a cover forming an outer peripheral surface portion of the connector;

a plug portion connected to said cover and a socket portion fitted in said cover and being arranged at a front side and at a rear side of the cover, respectively;

a shield extending inside said cover between said socket portion and plug portion;

a lock-engagement piece connected to said plug portion and positioned in the cover, said lock-engagement piece extending along an insertion direction of the connector, a proximal end of said lock-engagement piece being connected to said shield, the lock-engagement piece having a retaining projection opposite said proximal end and engageable with an engagement recess which is formed in a socket portion of another connector; and a lock-release button provided on a peripheral surface portion of said cover, said lock-release button being fixedly secured to the peripheral surface portion said cover, a free end of said lock-release button position between the rear side and front side of said cover being for pressing down a portion of said lock-engagement piece, wherein said plug portion includes an opening for receiving a free end of said lock-engagement piece when said lock-release button is in a normal position and a recess for receiving said free end of said lock-engagement piece when said lock-release button presses said lock-engagement piece inwardly.

2. An electrical branch-connection connector as claimed in claim 1, wherein the plug portion includes a socket-type contact having a tubular front end portion, a rear end portion defining a clamping portion to which a wire is connected and an intermediate portion having a tubular shape, and the intermediate portion having a withdrawal prevention lance and a contact portion, said lance extending obliquely rearwardly from a side surface of the intermediate portion, and wherein the socket portion includes a plug-type contact having a front end portion defining a cylindrical contact portion and a connection conductor portion integrally formed with a rear end of the cylindrical contact portion, wherein the connection conductor portion contacts the contact portion.

3. An electrical branch-connection connector as claimed in claim 1, wherein the cover includes an upper shield case, a lower shield case and a front cover connected to a rear cover.

4. An electrical branch-connection connector as claimed in claim 1, wherein the cover includes a cord end insertion hole portion for receiving a plurality of wires.

5. An electrical branch-connection connector as claimed in claim 1, wherein said lock-engagement piece comprises a flexible material.

6. An electrical branch-connection connect as claimed in claim 1, wherein said retaining projection includes an angled guide surface.

7. An electrical branch-connection connector as claimed in claim 1, wherein said plug includes a top adjacent said recess and said retaining projection projects from said top.

8. An electrical connector comprising a first connector including:

a body having a first end portion, a second end portion and a top portion;

a socket connected to said body at said first end portion;

a plug connected to said body at said second end portion, said plug including a second top portion;

a shield extending inside said body between said first end portion and said second end portion;

means for locking connected to said body at said top portion of said body and protruding through an opening of said second top portion of said plug, said locking means for locking said plug of said first connector within a socket of a second connector;

a recess formed in said plug below said locking means; and a lock release button connected to said body at said top portion of said body, wherein said lock release button causes said locking means to move into said recess when said lock release button is pressed downward and retract into said opening when said lock release button is released.

9. An electrical connector as in claim 8, wherein said locking means comprises a lock-engagement piece having a proximal end and a distal end opposite said proximal end, said proximal end being joined to said shield and said distal end extending along said.

10. An electrical connector as in claim 9, wherein said distal end includes a retaining projection, said retaining projection including an angled guide surface.

11. An electrical connector as in claim 8, wherein said lock release button includes a convex operating portion and a pressing portion, said pressing portion transmitting force from said convex operating portion to said locking means for moving said locking means into said recess.

12. An electrical connector as in claim 8, wherein said socket includes an engagement recess, said locking means engaging said engagement recess.

* * * * *